US011510530B2

(12) United States Patent
Cannon et al.

(10) Patent No.: US 11,510,530 B2
(45) **Date of Patent: *Nov. 29, 2022**

(54) BATH TISSUE DISPENSER ROLL HUB

(71) Applicant: von Drehle Corporation, Hickory, NC (US)

(72) Inventors: Danielle Cannon, Hickory, NC (US); Jason Gscheidmeier, Hickory, NC (US); David Hine, Hickory, NC (US)

(73) Assignee: von Drehle Corporation, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/503,807

(22) Filed: Oct. 18, 2021

(65) Prior Publication Data

US 2022/0031128 A1 Feb. 3, 2022

Related U.S. Application Data

(63) Continuation of application No. 16/720,703, filed on Dec. 19, 2019, now Pat. No. 11,179,012.

(51) Int. Cl.
*A47K 10/38* (2006.01)

(52) U.S. Cl.
CPC ..... *A47K 10/3836* (2013.01)

(58) Field of Classification Search
CPC . A47K 10/3836; B65H 16/04; B65H 2402/33
USPC ..... 242/597, 597.5, 597.8
See application file for complete search history.

(56) References Cited

U.S. PATENT DOCUMENTS

| | | | | |
|---|---|---|---|---|
| 2,477,961 | A | 8/1949 | Campbell | |
| 2,661,165 | A | 12/1953 | Salmonson | |
| 2,858,995 | A | 11/1958 | Sarro | |
| 3,061,217 | A | 10/1960 | Grant | |
| 3,079,099 | A | 2/1963 | Blain | |
| 4,060,209 | A | 11/1977 | Tsukamoto | |
| 4,690,343 | A | 9/1987 | Goetz | |
| 4,934,625 | A | 6/1990 | Richardson | |
| 5,653,403 | A | 8/1997 | Ritchey | |
| 5,996,931 | A | 12/1999 | Neveu et al. | |
| 9,661,959 | B2 | 5/2017 | Prior | |
| 11,179,012 | B2 * | 11/2021 | Cannon | A47K 10/16 |

OTHER PUBLICATIONS

U.S. Appl. No. 16/720,703 Office Action dated Apr. 29, 2021; 9 pages.

* cited by examiner

*Primary Examiner* — William A. Rivera
(74) *Attorney, Agent, or Firm* — John H. Thomas, P.C.

(57) ABSTRACT

The hub described herein is adapted for specialized use with relatively larger diameter tissue roll cores and large width rolls. The hub prevents the practical use of smaller tissue rolls having smaller core diameters and/or being a smaller width roll. The hub allows for custom matching a bath tissue roll with a particular hub for quality control purposes. The hub facilitates the installation of a predetermined uniform bath tissue to be mounted in a dispenser with the hub.

10 Claims, 6 Drawing Sheets

BATH TISSUE DISPENSER ROLL HUB

This application is a continuation of U.S. patent application Ser. No. 16/720,703 entitled Bath Tissue Dispenser Roll Hub, filed Dec. 19, 2019, which is incorporated by reference herein in its entirety.

The field of the invention is hubs for use in bath tissue dispensers. Specifically, the invention relates to specialized hubs engineered for use with particular-sized bath tissue rolls.

BACKGROUND

Many types and brands of bath tissues are commercially available. The bath tissue comes in different thicknesses, widths, textures and plys among other variables. Commercial dispensers are available to handle many or most of these different bath tissue products.

Sometimes, commercial tissue dispensers are intended to be used with non-standard size rolls. In many cases, tissue dispensers are given away at no-cost and to protect this investment, only the rolls of tissue designed to fit the dispenser can be used. The sales of tissue rolls protects the investment of development and the upfront cost of the dispensers. In one instance, but not limited to this instance, luxury facilities may desire a premium tissue with a non-standard size tissue roll. If a dispenser is only a standard size dispenser with a standard size hub to carry a roll of tissue, then only limited types of bath tissue may be acceptable for use. And if larger tissue rolls are intended for use, then the facility is likely not interested in smaller replacement tissue rolls because the rolls will not fit or function in their dispensers. In common dispensers, therefore, it is difficult to ensure a specified tissue will be purchased and supplied when multiple vendors might be competing for replacement bath tissue roll business, with each vendor having different bath tissue rolls for sale.

SUMMARY

It is therefore an object of the present invention to provide a custom dispenser that includes a hub especially designed to carry a predetermined size of bath tissue roll. The hub component of the dispenser supports a larger size roll of bath tissue with a particular roll core dimension.

In one example, a bath tissue hub is adapted to be mounted on a bath tissue dispenser, the hub comprising a hub having a first end and a second end and a connector rod between the first end and the second end. The first end has a top and a bottom and is round in longitudinal cross-section and has a first diameter adapted to be inserted into and support a core of a bath tissue roll, and the first end having a short longitudinal length. The second end has a top and a bottom wherein when mounted on the dispenser, the top end is vertically on the top of the hub; wherein the second end has a height between the top and bottom and the second end is adapted to be inserted into the core of a bath tissue roll, and further wherein the top of the second end comprises a lip with a short longitudinal length adapted to support the core of the bath tissue roll. The connector rod is a thin rod with a longitudinal diameter less than half of the first diameter of the first end; wherein the connector rod is attached on one end to the first end of the hub and on its opposite end proximate the bottom of the second end. The connector rod may be attached proximate the top of the first end of the hub, or it may be attached proximate the bottom of the first end of the hub. The diameter of the first end of the hub may be greater than 1.8 inches, or it may be 1.82 inches. The distance from the first end of the hub to the edge of the lip of the second end of the hub may be greater than 4.5 inches, or it may be 4.6 inches. The lip portion at the top of the second end of the hub may have a longitudinal length of 0.5 inches or less, or it may be 0.4 inches. The longitudinal length of the first end may be 0.5 inches or less.

BRIEF DESCRIPTION OF THE DRAWINGS

FIG. 1B is a side cross-sectional view of the dispenser and hub design shown in FIG. 1 without any bath tissue mounted on in.

DETAILED DESCRIPTION

Figure 1A:
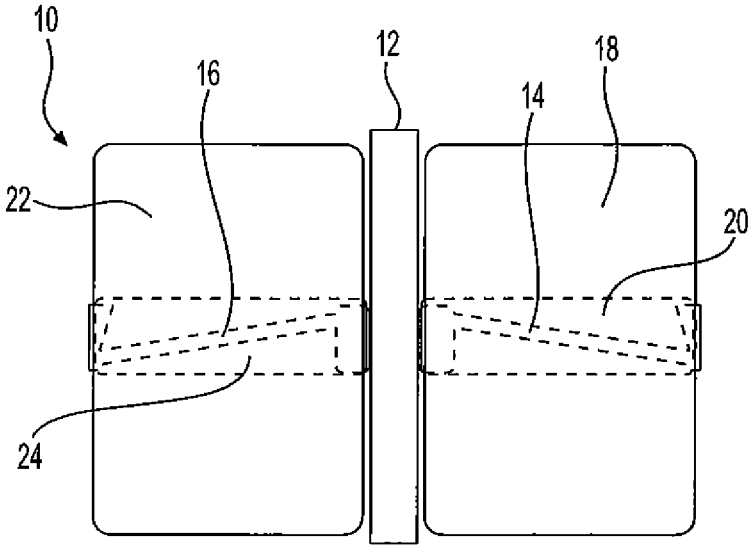
FIG. 1A is a side cross-sectional view of one example of a dispenser and hub design with two hubs and two rolls of bath tissue mounted on it.

The hub described herein is adapted for specialized use with relatively larger diameter tissue roll cores and large width rolls. The hub prevents the practical use of smaller tissue rolls having smaller core diameters and/or being a smaller width roll. The hub allows for custom matching a bath tissue roll with a particular hub for quality control purposes. The hub facilitates the installation of a predetermined uniform bath tissue to be mounted in a dispenser with the hub.

The hub described herein may be attached on either end to a dispenser. The dispenser may be a simple flat mount onto which are fixed one or more hubs. Alternatively, the dispenser may also include a housing that substantially encircles the space where the bath tissue is mounted to deter vandalism or theft. The hub is typically not symmetrical, but either end may be fixed in the dispenser. The hub is, however, in one example directional in that it is intended to be mounted so that there is a defined top and bottom of the hub. The hub may be removably attached to a dispenser for purposes of service and replacement. The hub may be removably attached so that different-sized hubs may be substituted for use with matching different-sized tissue rolls. A user or manager of a dispenser may decide to change bath tissue suppliers or styles, so a different dimension hub may be needed. Still further alternatively, the hub may be permanently fixed to a dispenser to ensure that a constant size of bath tissue will be used with the dispenser.

The hub has a first end, a second end, and a connector rod in between. Each of these components is discussed separately. Each of these components may be formed of metal or plastic or a combination of the two materials. The components in a single hub may be made of the same or different materials.

The first end of the hub is a round, disc-like component. Alternatively, it may be hexagonal or octagonal or star-shaped or have fins in cross-section that support a round tissue roll hub. The first end may be solid or hollow. The first end has a longitudinal length of 0.5 inches or less. It has a length that is not enough to itself support and allow the unwinding of a tissue roll. The cross-sectional diameter of the first end is adapted to fit inside the core of a roll of bath tissue. Many conventional rolls of bath tissue have a core diameter of 1.6 to 1.8 inches. The present first end has a cross-sectional diameter of at least 1.82 inches or more, and is able to carry a 2 inch core roll. By setting a minimum diameter of 1.82 inches, a conventional roll core is blocked from and cannot slide over the first end and allow free spinning of a roll of bath tissue. In this example, therefore, a roll core must be 1.82 inches or greater than the cross-sectional dimension of the first end.

The second end of the hub has a top and a bottom as oriented with respect to a floor or surface over which the tissue dispenser will be mounted. The top of the second end has a lip that protrudes backwardly from the end of the hub toward to first end. The top of the lip is generally parallel to the top of the first end. The lip has a longitudinal length of less than 0.5 inches, or alternatively less than 0.4 inches. It is the top of the lip that is adapted to carry one end of the tissue roll core. The top lip may define the top surface of a disc-like shape or it may extend backwardly more than the remaining height of the second end. In other words, the inside of the second end closest to the first end may taper away from the first end from the top to the bottom of the second end.

The connector rod is fixed on one end to the first end of the hub and on its opposite end to the second end of the hub. The rod is relatively narrow in longitudinal cross-section. The connector rod has a cross-sectional diameter or height that is half or less than the first end diameter. The connector rod is connected to the second end of the hub proximate the bottom of the second end. The top surface of the rod is at least at or below a midline of the height or diameter of the second end. The connector rod may be attached generally anywhere on the height of the first end of the hub. The rod may be connected proximate the upper, middle or bottom of the first end. Functionally, a bath tissue roll must have a core long enough to extend from the top of the first end to the top of the lip on the second end in order to support and allow free spinning of the roll of tissue. If a tissue roll is too short or narrow in width, it will be supported unevenly, because it does not reach the second end lip. Rotation of the roll will be impeded so that it may not spin freely if installed in the present hub and it will fall off the end of the hub. In one example, the distance from the first end of the hub to the edge of the lip of the second end of the hub is greater than 4.5 inches, in another example, the distance is 4.6 inches. In this example, a roll having a width of less than 4.5 inches will not function well.

Figure 1B:
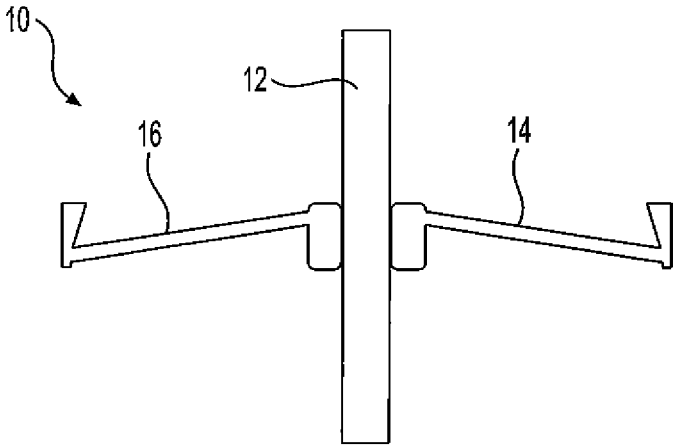

Turning now to the figures, there are shown multiple examples of dispenser designs. FIGS. 1A and 1B are side views of a dispenser 10 having a central dispenser mount 12 with hubs 14 and 16 fixed to and protruding from opposite sides of the mount. In FIG. 1A, bath tissue rolls 18 and 22 are mounted on the hubs 14 and 16 respectively. The tissue rolls 18 and 22 each have a tubular core 20 and 24 respectively that are mounted onto and that rotate around hubs 14 and 16 as shown. In the example of dispenser 10, a pair of hubs 14 and 16 is shown. A dispenser and hub as described herein also includes single hubs and three or more hubs depending on a particular hub design and intended use. In multiple hub examples, there may be different orientations and layouts for many aesthetic or utilitarian reasons.

Figure 2:
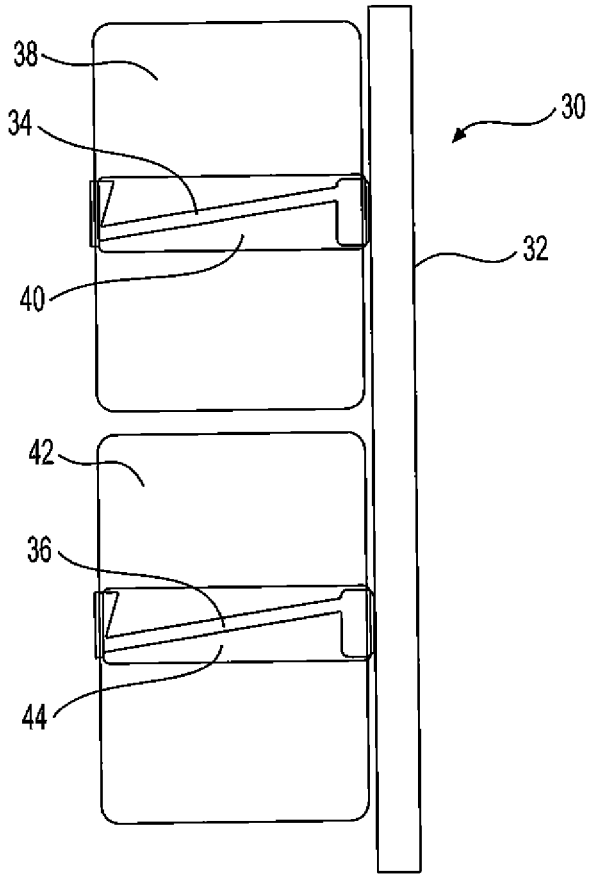
FIG. 2 is a side cross-sectional view of a second example of a dispenser and hub design with two hubs and two rolls of bath tissue mounted on it.

FIG. 2 is a side view of a second example of a dispenser 30 with top and bottom hubs 34 and 36 fixed onto mount 32. In this FIG. 2, bath tissue rolls 38 and 42 are positioned on hubs 34 and 36 respectively. Each tissue roll 38 and 42 has a tubular core 40 and 42 that slides over and is rotatable on the hubs 34 and 36 respectively.

Figure 3:
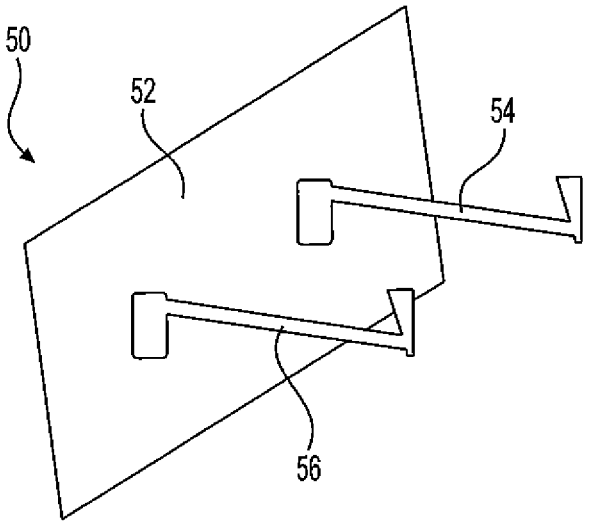
FIG. 3 is a side cross-sectional view of a third example of a dispenser and hub design with two hubs and without rolls of bath tissue mounted on it.

FIG. 3 is a perspective view of dispenser 50 having side-by-side hubs 54 and 56 fixed to the mount 52 of the dispenser. The hubs 54 and 56 extend outwardly and next to each other in this third example of a dispenser 50.

Figure 4:
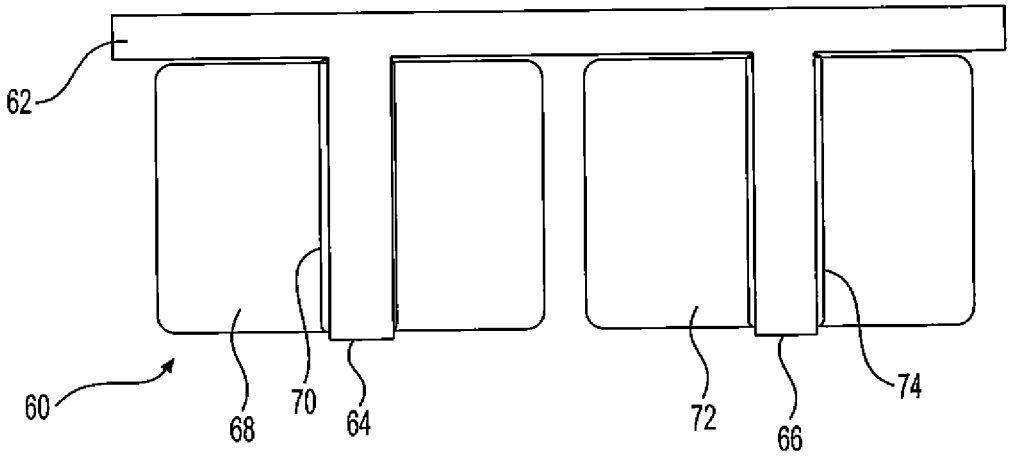
FIG. 4 is a top view of the third example of a dispenser and hub design with two hubs and two rolls of bath tissue mounted on it.

FIG. 4 is a top, cross-sectional view of a dispenser 60 with two hubs 64 and 66 extending outwardly from mount 62 and fixed onto the same side of the mount. There is also shown bath tissue rolls 68 and 72 and their respective tubular roll cores 70 and 74. The cores 70 and 74 rotate on the respective hubs 64 and 66.

Figure 5:
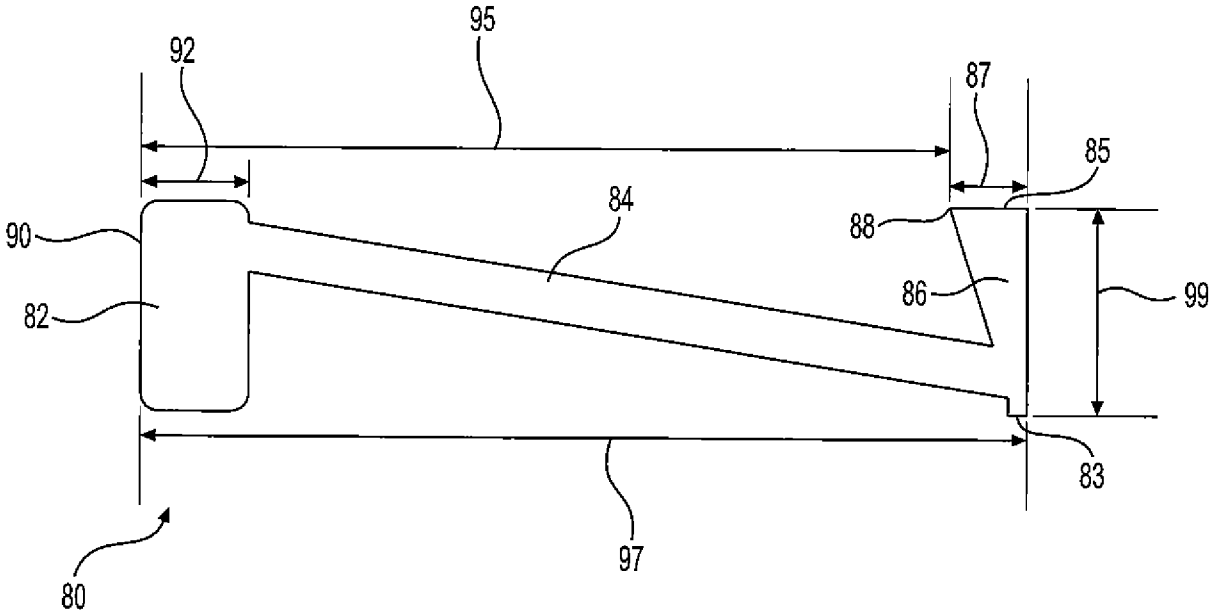
FIG. 5 is a side view of an example of a single hub as described herein.

FIG. 5 is a side view of a hub 80 as described herein. The hub 80 has a first end 82, a connector rod 84 and a second end 86. The first end 82 has a first outside face 90 on the side of the first end opposite the side where the connector rod 84 is connected to the first end. The longitudinal cross section of the first end 82 is generally round in shape and tubular along its longitudinal length. The first end 82 has a longitudinal length 92 of about a half inch. The second end 86 is directional in that it has a top 85 and a bottom 83 when the hub 80 is installed onto a mount (not shown). The top 85 of the second end 86 has a longer longitudinal length 87 than the bottom 83. The second end 86 may be tapered in a triangular shape as shown from its top 85 to bottom 83. Alternatively, the top 85 may be a thin and narrow construction. The inside of the top 85 is referred to as the lip 88. The various dimensions of the hub 80 are significant to the operation of the hub. The height 99 of the hub 80 represents the round diameter of the first end 82 and second end 86. This height 99 has different sizes depending on the inside diameter of a tissue roll core that is intended to be mounted onto the hub as explained earlier herein. The overall length 97 of the hub 80 must be wide enough to support a particular size of bath tissue roll. Therefore, this length 97 will be more wide for wide rolls and more narrow for conventional or narrow rolls.

Figure 6A:
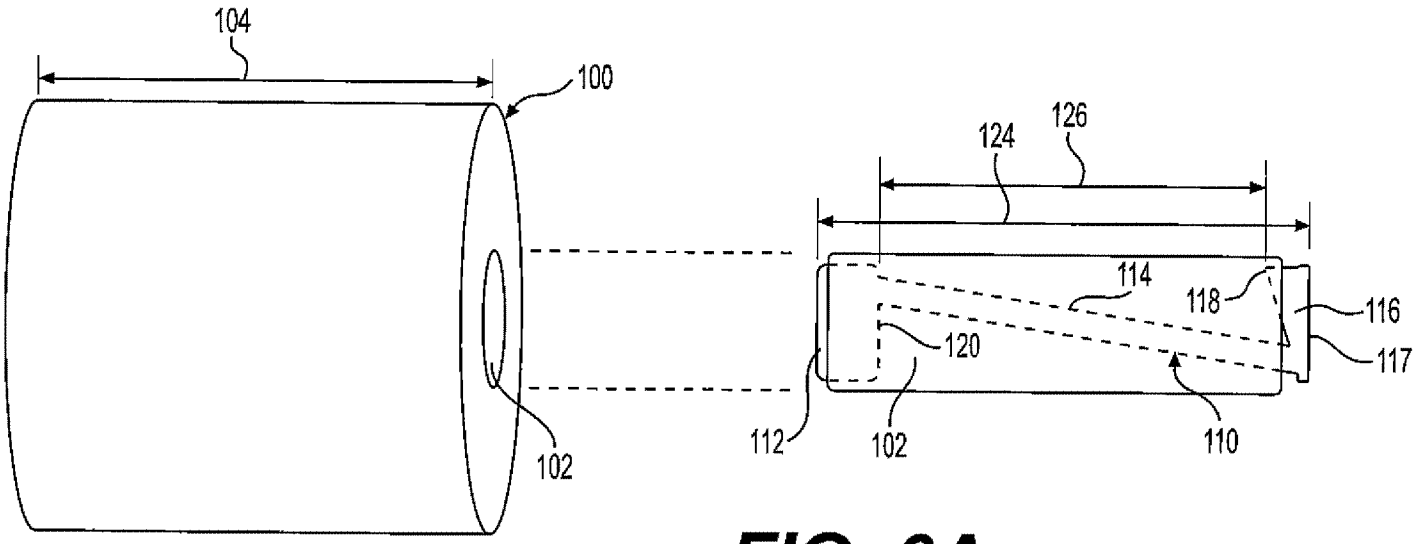
FIGS. 6A and 6B are side views of a hub as described herein with an extra-large and wide roll (FIG. 6A) and a regular, normal size roll (FIG. 6B).
Figure 6B:
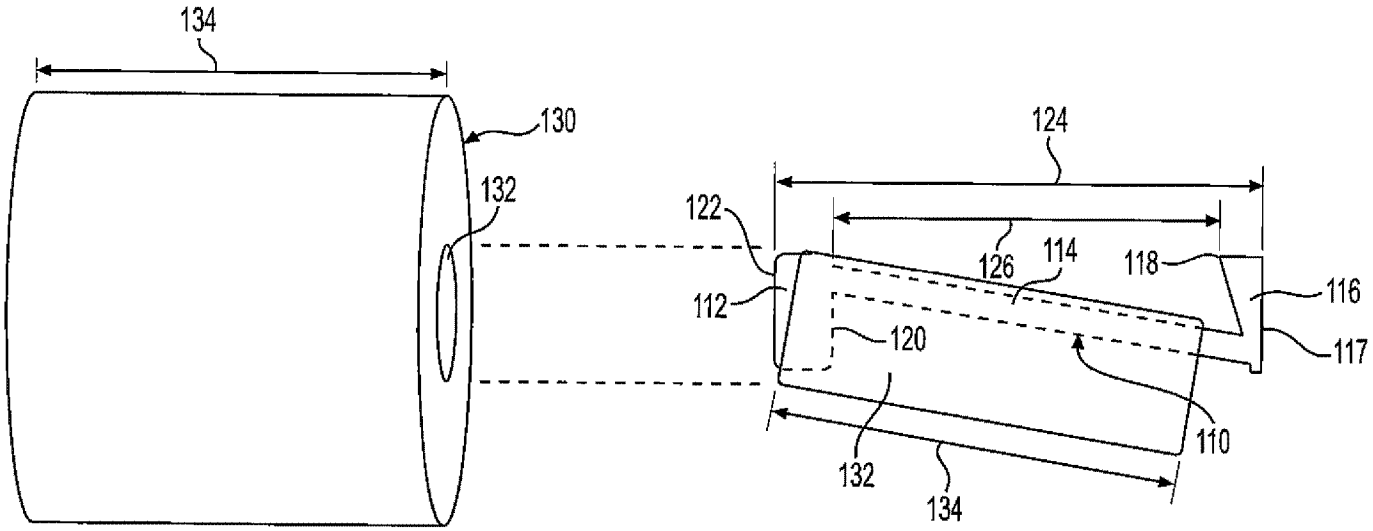

FIGS. 6A and 6B illustrate the operation of a hub 110 as it might be used with a wide roll of tissue 100 versus a conventional narrow roll of tissue 130. In FIG. 6A, a wide roll of tissue 100 has a core 102 and has a width 104. The core 102 is shown where it fits over the hub 110 and extends from the first end 112 to the second end 116 and is supported on both ends. The first end 112 of the hub 110 has an outside face 122 and inside face 120. The second end 116 of the hub 110 has an outside face 117 and the inside of its lip 118. The connector rod 114 is shown connected to near the top of the first end 112 and then to near the bottom of the second end 116. The width 104 of the tissue roll 100 and its core 102 is less than the first distance 124 from the outside faces 122 and 117 of the first end 112 and second end 116 respectively. The width is also greater than the second distance from the inside face 120 of the first end to the lip 118 of the second end 116. In this way, the tissue 100 is held flat and even and may roll freely on the hub 110.

FIG. 6B illustrates what happens when a conventional or narrow roll of bath tissue 130 is placed onto the hub 110. The roll of tissue 130 has a core 132 and a width 134. Importantly, this roll is tissue 130 is placed over the first end 112, but it is not wide enough to extend to the lip 118 of the second end 116. Consequently, the roll 130 will fall crooked and not unwind very well during use. Importantly, the width 134 of the tissue roll 134 is less than the second distance 126 from the inside face 120 of the first end 112 to the lip 118 of the second end 116. It is readily apparent that a wide roll such as roll 100 is required to fit and function properly on the hub 110.

Figure 7A:
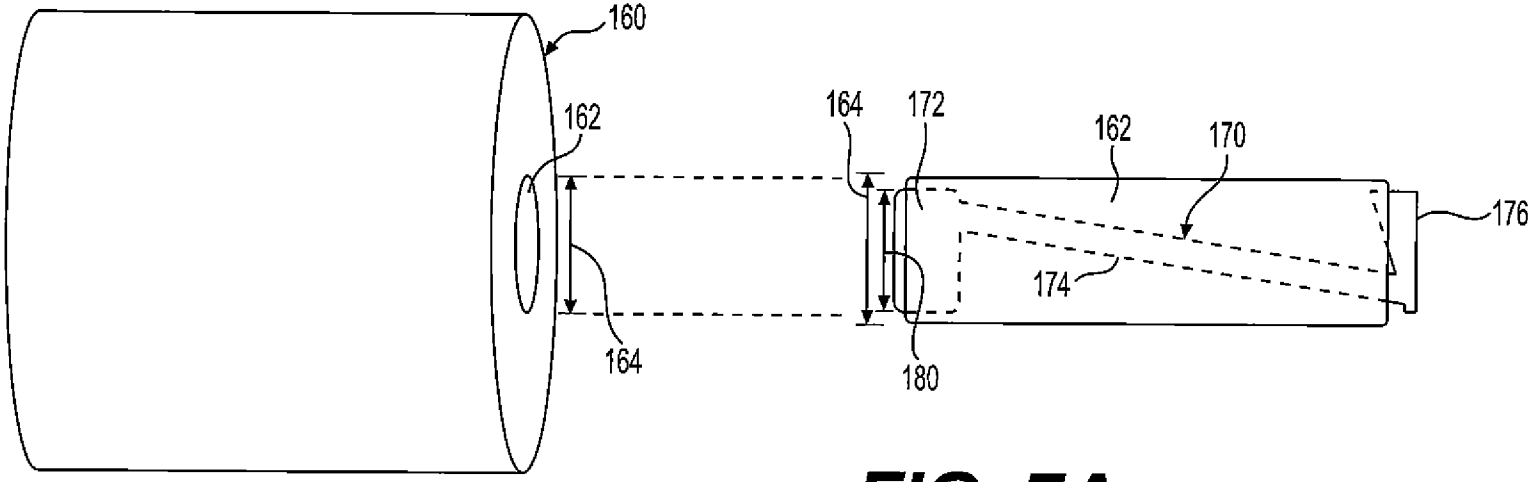
FIGS. 7A and 7B are side views of a hub as described herein with an extra-large and wide roll (FIG. 7A) and a regular, normal size roll (FIG. 7B).
Figure 7B:
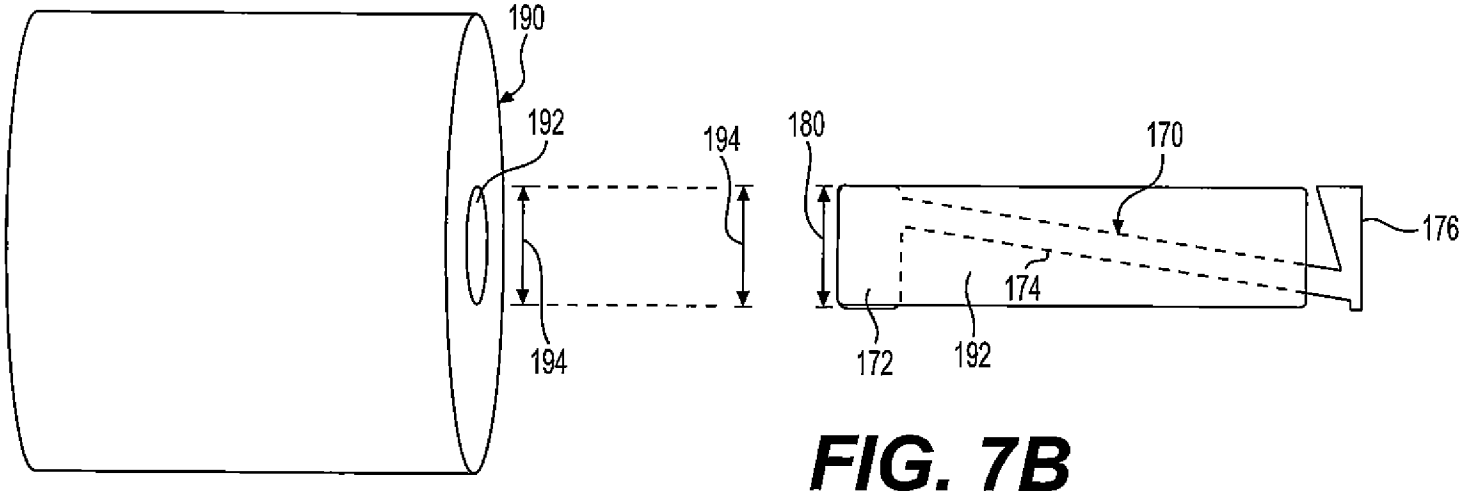

FIGS. 7A and 7B illustrate how the height/diameter 180 of the hub may be lengthened to accommodate only wider cores of tissue rolls. In FIG. 7A, a roll of tissue 160 has a core 162 with an inside diameter 164. This core diameter 164 is sized to properly fit over and around the first end 172 and second end 176. The core diameter 164 is greater than the height 180 of the hub 170. The hub 170 is sized so that it is greater than the inside diameter 164 of the core 162. This inside diameter 164 is greater than the inside diameter of conventional core of bath tissue. This allows tissue roll 160 to rotate freely around the hub 170.

In FIG. 7B, a conventional roll of tissue 190 has a core 192 and core inside diameter 194 that is smaller than that of the large tissue roll 160. This inside diameter 194 is less than the height/diameter 180 of the first end 172 and second end 176 of the hub 170. Therefore, the roll of tissue 190 cannot slide onto or rotate freely around the hub 170. As shown in FIGS. 7A and 7B, this is a second way to control what size of bath tissue to use in a particular dispenser.

Other embodiments of the present invention will be apparent to those skilled in the art from consideration of the specification. It is intended that the specification and figures be considered as exemplary only, with a true scope and spirit of the invention being indicated by the claims.

That which is claimed is:

1. A bath tissue hub adapted to be mounted on a bath tissue dispenser, the bath tissue hub comprising:

a first end and a second end and a connector rod between the first end and the second end;

the first end having a top and a bottom and having a first diameter adapted to be inserted into and support a core of a bath tissue roll, and the first end having a short longitudinal length;

the second end having a top and a bottom wherein when the bath tissue hub is mounted on the dispenser, the second end top is vertically on the top of the bath tissue hub; wherein the second end has a height between the top and bottom and the second end is adapted to be inserted into the core of a bath tissue roll, and further wherein the top of the second end comprises a lip with a short longitudinal length adapted to support the core of the bath tissue roll;

the connector rod is a thin rod with a longitudinal diameter less than the first diameter of the first end; wherein the connector rod is attached on one end to the first end of the bath tissue hub and on its opposite end below the top of the second end.

2. A bath tissue hub as described in claim 1, wherein the connector rod is attached proximate the top of the first end of the hub.

3. A bath tissue hub as described in claim 1, wherein the connector rod is attached proximate the bottom of the first end of the hub.

4. A bath tissue hub as described in claim 1, wherein the diameter of the first end of the hub is greater than 1.8 inches.

5. A bath tissue hub as described in claim 1, wherein the diameter of the first end of the hub is 1.82 inches.

6. A bath tissue hub as described in claim 1, wherein the distance from the first end of the hub to the edge of the lip of the second end of the hub is greater than 4.5 inches.

7. A bath tissue hub as described in claim 1, wherein the distance from the first end of the hub to the edge of the lip of the second end of the hub is 4.6 inches.

8. A bath tissue hub as described in claim 1, wherein the lip portion at the top of the second end of the hub has a longitudinal length of 0.5 inches or less.

9. A bath tissue hub as described in claim 1, wherein the lip portion at the top of the second end of the hub has a longitudinal length of 0.4 inches.

10. A bath tissue hub as described in claim 1, wherein the longitudinal length of the first end is 0.5 inches or less.

* * * * *